US005632475A

United States Patent [19]

McCanse

[11] Patent Number: 5,632,475

[45] Date of Patent: May 27, 1997

[54] WORK HOLDING APPARATUS

[75] Inventor: James E. McCanse, Ogle, Ill.

[73] Assignee: McCanse Engineering Incorporated, Oregon, Ill.

[21] Appl. No.: 396,491

[22] Filed: Mar. 2, 1995

[51] Int. Cl.[6] ..... B66F 3/00

[52] U.S. Cl. ..... 269/17; 269/69; 269/71; 269/296; 269/88; 254/134

[58] Field of Search ..... 254/2 B, 133, 254/134, 100; 269/17, 68, 69, 71, 296, 88

[56] References Cited

U.S. PATENT DOCUMENTS

| | | | |
|---|---|---|---|
| D. 348,134 | 6/1994 | McCanse et al. . | |
| 2,669,422 | 2/1954 | Branick | 254/134 |
| 2,707,819 | 5/1955 | Silliman | 269/68 |
| 2,973,198 | 2/1961 | Marks | 269/69 |
| 5,051,056 | 9/1991 | Gibbons et al. | 254/134 |
| 5,141,211 | 8/1992 | Adams | 269/69 |
| 5,324,005 | 6/1994 | Beattie et al. | 254/134 |
| 5,338,015 | 8/1994 | Liegel et al. | 254/134 |
| 5,339,926 | 8/1994 | McCanse et al. . | |
| 5,505,578 | 4/1996 | Fuller | 269/17 |

OTHER PUBLICATIONS

Advertising Brochure by Golf Lift, Inc. for "The Original Golf Lift" (copyright 1993).

Advertising Brochure by Triton Lifts, Inc. for a "Triton Model 2600 Lift" (copyright 1992).

Advertising Brochure by Wheeltronic for a "Model 8093 VGL".

Advertising Brochure by Precision Metal Works for a "MP 6000# Surface Mounted Utility Lift".

Advertising Brochure by Western Manufacruring Corp. for a "Handy Air Lift".

Advertising Brochure by Garber Seeders Co., Inc., for various "Lawn Mower Lifts", including Model Nos. 350; 360; and 370.

Advertising Brochure by Atlantic Specialty Lifts Ltd. for an "ATV 2500".

Advertising Brochure by G & H Products for a "Uni-Lift" Model 380.

Advertising Brochure by Specialty Motors, Inc. for various "Power Equipment Lifts", including Model Nos. PEL-1200; STL-1500; WB-500; and LM-R-300.

Advertising Supplement from the Jul. 1993 edition of "Golf Course Management" for a GolfLink work platform manufactured by Derek Weaver Co. Inc.

*Primary Examiner*—Robert C. Watson

*Attorney, Agent, or Firm*—Leydig, Voit & Mayer, Ltd.

[57] ABSTRACT

The preferred apparatus is in the form of a service lift for holding a machine such as a walk-behind lawnmower during servicing and repair thereof. The lift includes a main support movable upwardly and downwardly on a column, a subsupport adapted to be rotated to and held in various angular positions relative to the main support, and side-by-side tubes on the subsupport for telescopically receiving bars for supporting the mower or other machine during servicing. The supporting bars extend in opposite directions from the side-by-side tubes and may be laterally adjusted relative to the tubes to match the width of the machine being serviced. Supporting bars for other types of machines may be inserted into the tubes, and the main support and the subsupport may be vice-mounted rather than column-mounted.

13 Claims, 5 Drawing Sheets

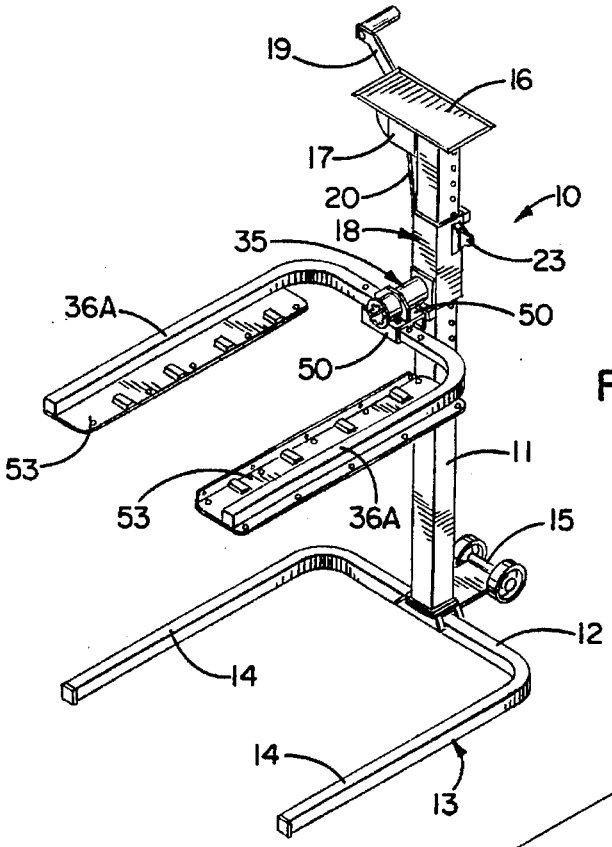
FIG. 1
FIG. 2
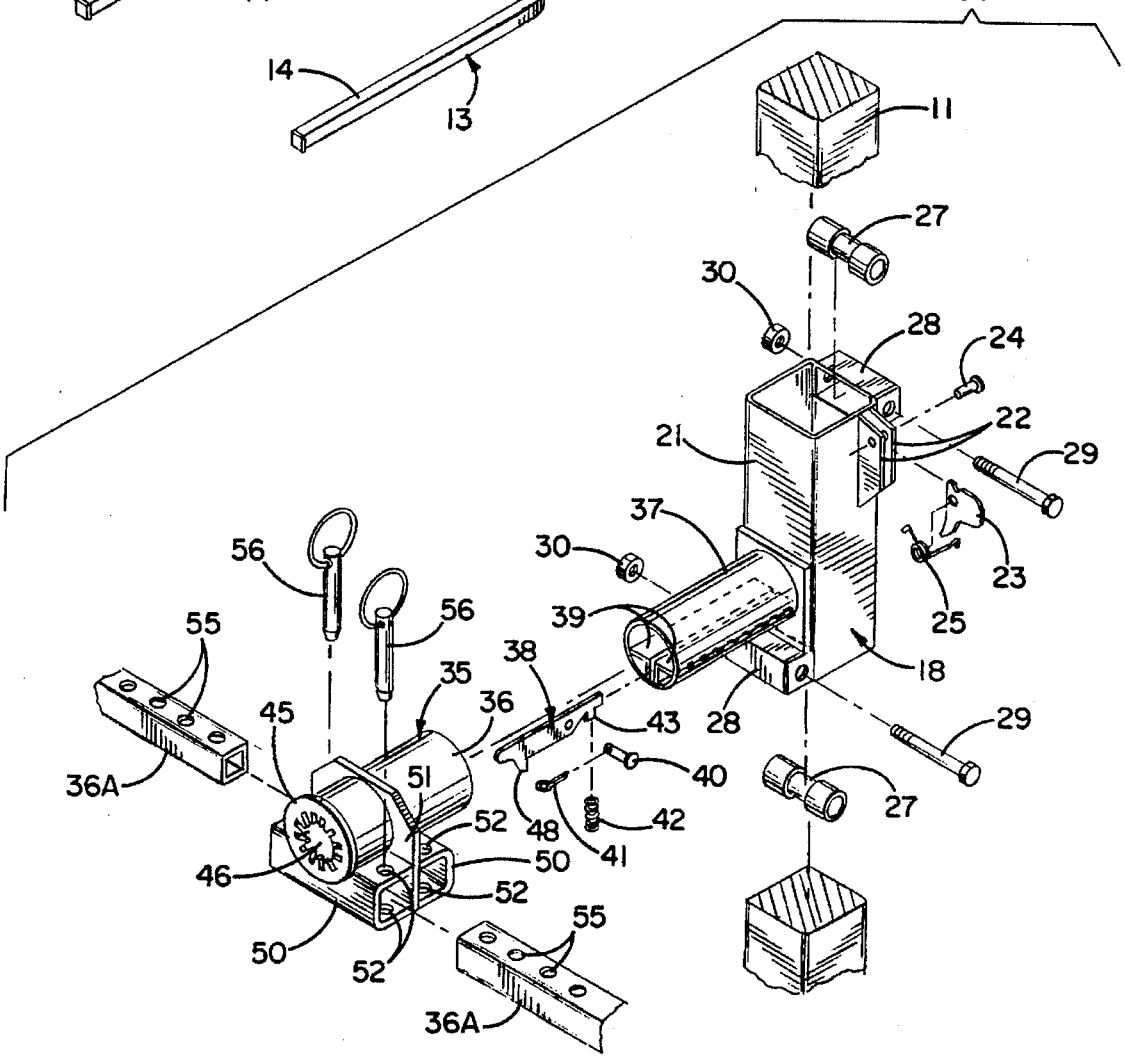

WORK HOLDING APPARATUS

BACKGROUND OF THE INVENTION

This invention relates to work holding apparatus and, more particularly, to apparatus for holding a machine such as a walk-behind lawnmower during servicing of the mower. With many machines, it is desirable to lift the machine to a comfortable working height in order to facilitate repair or servicing of the machine and particularly to enable convenient access to the underside of the machine. Also, it is often advantageous to turn the machine to different angular positions in order to gain access to a particular part of the machine.

While work holding apparatus of the foregoing type generally exists, such apparatus is somewhat complex, does not readily lend itself for use with various types of machines, and does not always enable the machine to be oriented in the most convenient angular position.

SUMMARY OF THE INVENTION

The general aim of the present invention is to provide new and improved work holding apparatus of the above general type which is of relatively simple and low cost construction, which is extremely versatile and capable of handling many different types of machines, and which enables the machine to be turned through a wide range of angles to facilitate servicing of the machine.

A more detailed object of the invention is to provide work holding apparatus having unique supports for work holding fixtures, the supports enabling the use of various types of fixtures and enabling easy lateral adjustment of the fixtures to accommodate the width of the particular machine being serviced.

Still another object is to provide work holding apparatus in which the supports for the work holding fixtures may be turned to and held in a variety of angular positions so as to enable convenient access to various areas of the machine being serviced.

The invention also resides in the provision of comparatively simple and inexpensive latching apparatus for holding the fixture supports in a desired angular position and also for holding the supports in assembled relation with the main support of the apparatus.

The invention also is characterized by the ability of the apparatus to accommodate different types of work holding fixtures and to be supported by a vice on a work bench in those instances where a service lift is not required or is not available.

These and other objects and advantages of the invention will become more apparent from the following detailed description when taken in conjunction with the accompanying drawings.

BRIEF DESCRIPTION OF THE DRAWINGS

FIG. 1 is a perspective view of one embodiment of new and improved work holding apparatus incorporating the unique features of the present invention.

FIG. 2 is an enlarged exploded perspective view of certain components shown in FIG. 1.

Figure 3:
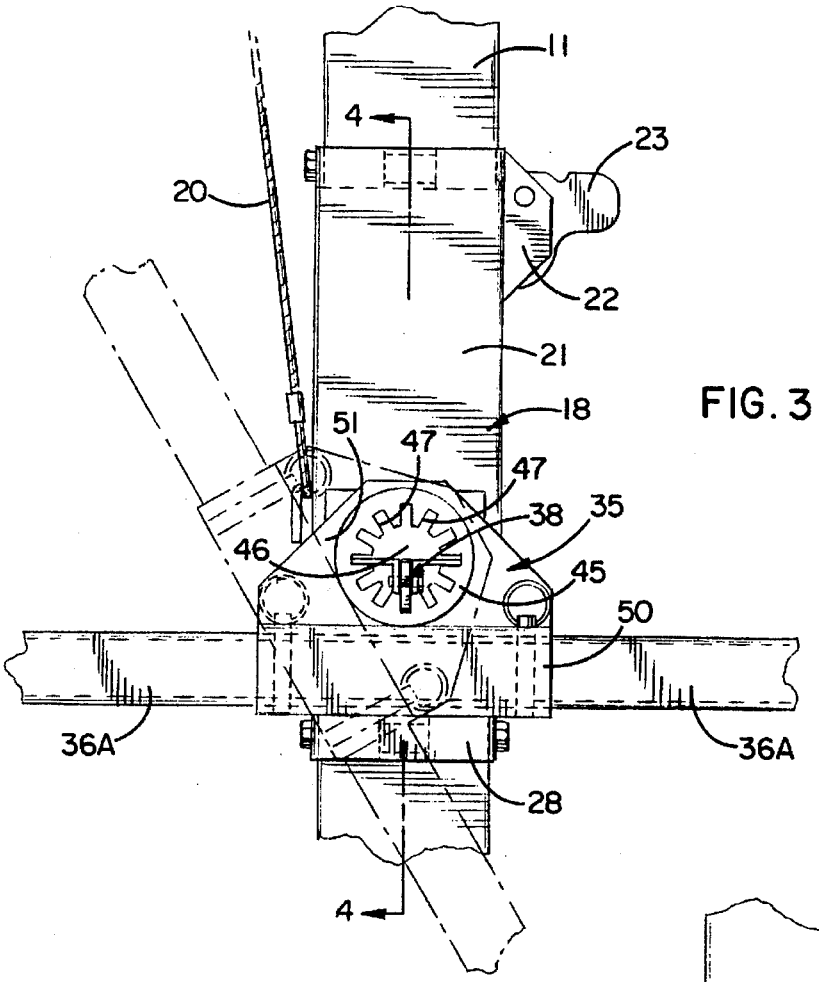
FIG. 3 is an enlarged fragmentary front view of the apparatus shown in FIG. 1.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

For purposes of illustration, the invention has been shown in the drawings as incorporated in apparatus 10 for holding various types of machines to facilitate servicing and repair of the machine. A typical machine may, for example, be a walk-behind lawnmower (not shown).

The apparatus 10 which has been shown in FIGS. 1–4 includes an upright column 11 whose lower end is supported on the crossbar 12 of a generally U-shaped base 13 having a pair of forwardly extending and laterally spaced legs 14 for stabilizing the column. A wheel assembly 15 is connected to and extends rearwardly from the crossbar to facilitate moving of the apparatus 10 from place-to-place when the column 11 is tilted downwardly and rearwardly.

A tray 16 for holding tools is supported on the upper end of the column 11. Attached to the column below the tray is a winch 17 for raising and lowering a main support 18 in order to move the support to various vertical positions on the column. The winch is adapted to be operated by a hand crank 19 and is connected to the main support 18 by a cable 20. The winch is a safety winch in that it cannot overrun the crank and thus the winch stops whenever the crank is released.

In this instance, the main support 18 includes a length of square tube 21 which is telescoped slidably over the column 11. Two flanges 22 project from one side of the tube and straddle a safety latch 23 which is pivotally supported between the flanges by a pin 24, the latch being urged to a latched position by a torsion spring 25. When the winch 17 is operated to lift the tube 21, the latch automatically ratchets into and out of vertically spaced holes 26 (FIG. 4) in the column 11 and then lodges in one of those holes when the tube has reached the desired elevation. The latch serves as a safeguard in the event the cable 20 breaks or in the event the winch fails. When the winch is operated to lower the tube, the latch must be held manually in an unlatched position.

To support the tube 21 on the column 11 while reducing the friction between the two, upper and lower rollers 27 are supported in cages 28 at the upper and lower ends of the tube and engage the rear and front sides, respectively, of the column. The upper cage is located at the rear side of the tube while the lower cage is located at the forward side of the tube. The rollers are supported for rotation on bolts 29 which extend through the cages and which are secured by nuts 30.

In accordance with one aspect of the present invention, a subsupport 35 is connected to the main support 18, is adapted to support holders 36A for supporting the machine to be serviced, and is adapted to be turned to and held in various angular positions relative to the column 11. In this instance, the subsupport 35 is defined in part by a sleeve 36 which is adapted to be telescoped onto and selectively rotated relative to a second sleeve 37 welded to and extending forwardly from the lower end portion of the tube 21 and forming part of the main support 18. A latching member 38 serves to hold the sleeve 36 in a selected angular position on the sleeve 37 and also serves to hold the sleeves in axially assembled relation.

Figure 4:
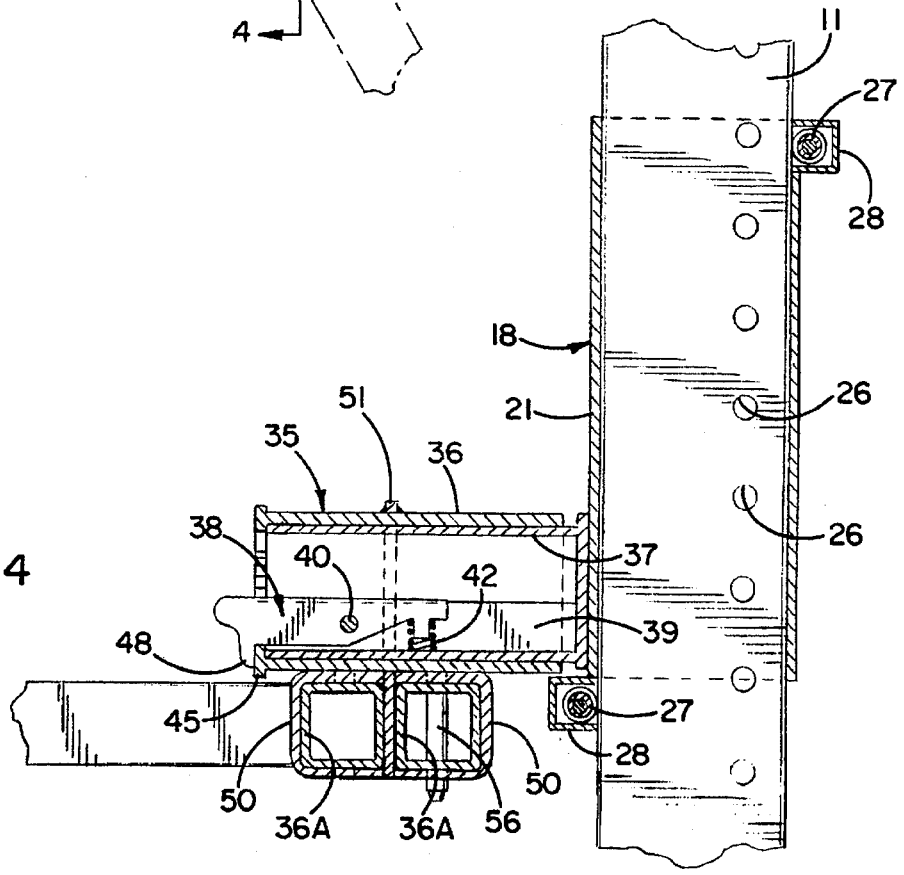
FIG. 4 is a fragmentary cross-section taken substantially along the line 4—4 of FIG. 3.

As shown most clearly in FIGS. 2 and 4, the latching member 38 comprises an elongated plate which is supported in the sleeve 37 within a gap defined between two angle irons 39 secured in the sleeve. The latching member is supported for vertical pivoting between latched and unlatched positions by a pivot pin 40 extending horizontally through the latch and the angle irons and retained by a cotter pin 41. A coil spring 42 is located in the gap between the angle irons, is piloted onto a depending lug 43 on the rear end portion of the latching member and serves to urge the latching member counterclockwise about the pin 40 to a latched position.

Coacting with the latching member 38 is a latching plate 45 which is secured to the forward end of the outer sleeve 36. The plate is formed with a central opening 46 (FIG. 3) through which the forward or free end portion of the latching member 38 extends. Several (herein, twelve) angularly spaced detents in the form of notches 47 are formed in the plate 45 around the peripheral edge portion of the opening 46. The free end portion of the latching member normally seats in one of the notches and prevents the sleeve 36 from turning on the sleeve 37. By manually lifting the free end portion of the latching member out of a notch 47 and into the main portion of the opening 46, the sleeve 36 is released for turning and may be relatched after being turned through one or more increments of 30 degrees each.

Advantageously, a depending tooth 48 (FIG. 4) is formed integrally with the latching member 38 near the free end thereof. Normally, the tooth engages the forward side of the latching plate 45 below the notch 47 at the six o'clock position in order to hold the sleeve 36 in axially assembled relation with the sleeve 37. By manually pivoting the latching member to its unlatched position, the tooth 48 may be raised into the opening 46 in the plate 45 to permit the sleeve 36 to be slipped axially off of the sleeve 37.

According to a further aspect of the invention, the subsupport 35 includes extremely simple and versatile means for adjustably supporting the work holders 36A. Herein, these means comprise a pair of side-by-side square tubes 50 extending transversely of and secured to one side of the sleeve 36. The tubes are defined by C-shaped channels welded to opposite sides of the lower end portion of an apertured plate 51 which is slipped over and welded to the sleeve 36 about midway between the ends thereof. Each tube is relatively short (e.g., 6") and each includes end portions projecting equidistantly beyond the sleeve 36. Each end portion of each tube is formed with a set of vertically aligned holes 52 (FIG. 2).

The particular work holders 36A which have been shown are formed by square tubes or bars and each is generally L-shaped (see FIG. 1). Attached to the underside of the longer leg of each bar 36A is a trough 53 for supporting the wheels of the mower or other machine to be serviced. Advantageously, the short legs of the bars 36A telescope into the tubes 50 and extend in opposite directions therefrom so that the troughs are positioned in laterally spaced relation. The short leg of each bar 36A is formed with a series of laterally spaced and vertically extending holes 55 (FIG. 2). Each bar is attached to its respective tube 50 by a pin 56 adapted to extend through the holes 52 in the end portion of the tube adjacent the bar and through a selected pair of vertically spaced holes 55 in the bar. By removing the pins and telescoping the bars into or out of the tubes, the lateral spacing of the troughs 53 may be adjusted to match the lateral spacing between the wheels of the mower. Because the tubes 50 are disposed in side-by-side relation and because the short legs of the bars 36A extend in opposite directions from the tubes, significant lengths of the short legs may overlap and thus the troughs may be positioned in very closely spaced relation if necessary.

From the foregoing, it will be apparent that the present invention brings to the art comparatively simple but extremely versatile work holding apparatus 10. When the apparatus is being used, for example, to support a walk-behind mower for servicing, the winch 17 may be used to lower the main support 18 downwardly until the troughs 53 rest on the floor. The bars 36A then may be adjusted laterally according to the lateral spacing between the mower wheels. After the mower has been rolled onto the troughs, the mower is tied to the bars and/or the troughs by straps (not shown). The winch then may be operated to lift the mower to a convenient service height.

The phantom line illustration in FIG. 3 shows the sleeve 36 rotated so as to position the tubes 50 and the bars 36A at an angle of 60 degrees relative to horizontal. This enables good access to the underside of the mower and, with most mowers, oil and gasoline will not spill from the engine when the mower is so tilted. And, as pointed out above, the latch 38 and the notched plate 45 permit the mower to be completely inverted or to be positioned at any other angle which is a multiple of thirty degrees.

Figure 5:
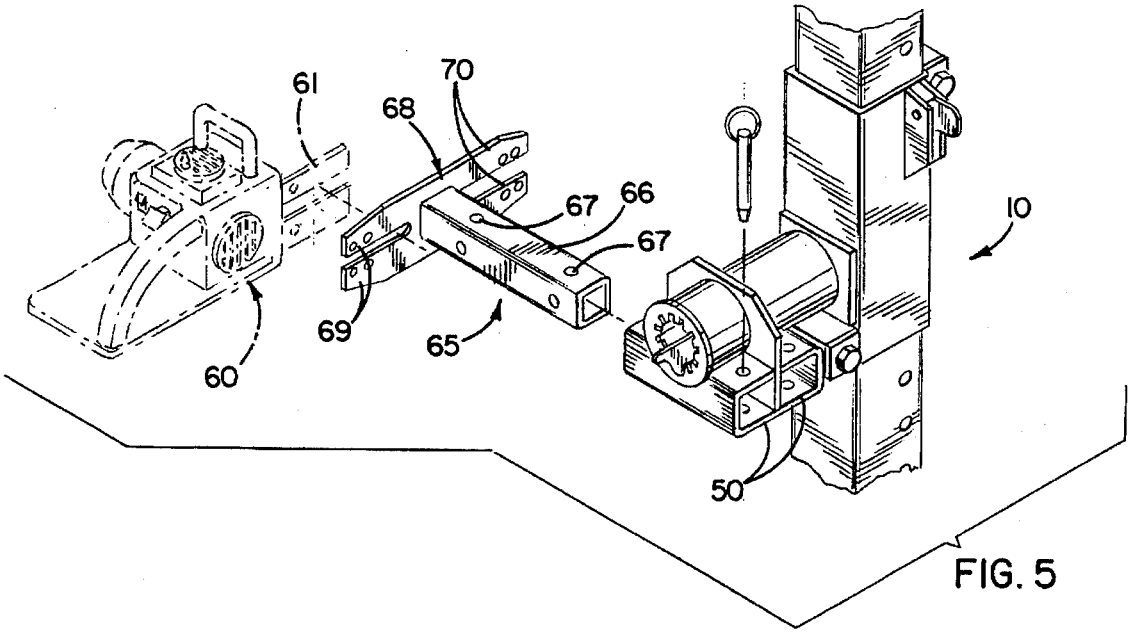
FIG. 5 is an exploded perspective view showing the apparatus set up for servicing of a chain saw.

FIG. 5 shows the apparatus 10 set up for servicing of a chain saw 60 having a chain bar 61. For this purpose, provision is made of a service bracket 65 comprising a square tube or bar 66 adapted to be telescoped into one of the tubes 50 and having holes 67 for receiving the pin 56. A vertically disposed plate 68 is welded to the free end of the bar 66 and is formed at one end with vertically spaced and apertured extensions 69 and at its opposite end with vertically spaced and apertured extensions 70. The bar 61 of the chain saw 60 may be bolted to one of the pairs of extensions and thus the saw is securely held in an elevated position for servicing. The extensions 69 and the extensions 70 are differently configured and are differently apertured in order to accommodate various models of chain saws.

Figure 6:
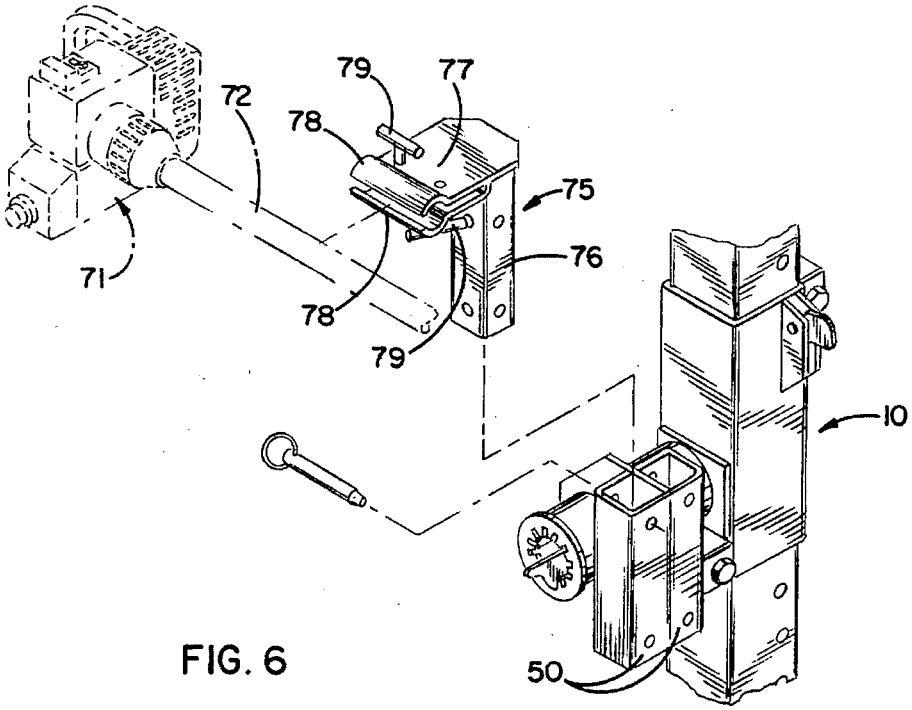
FIG. 6 is an exploded perspective view showing the apparatus set up for servicing of a string trimmer.
Figure 7:
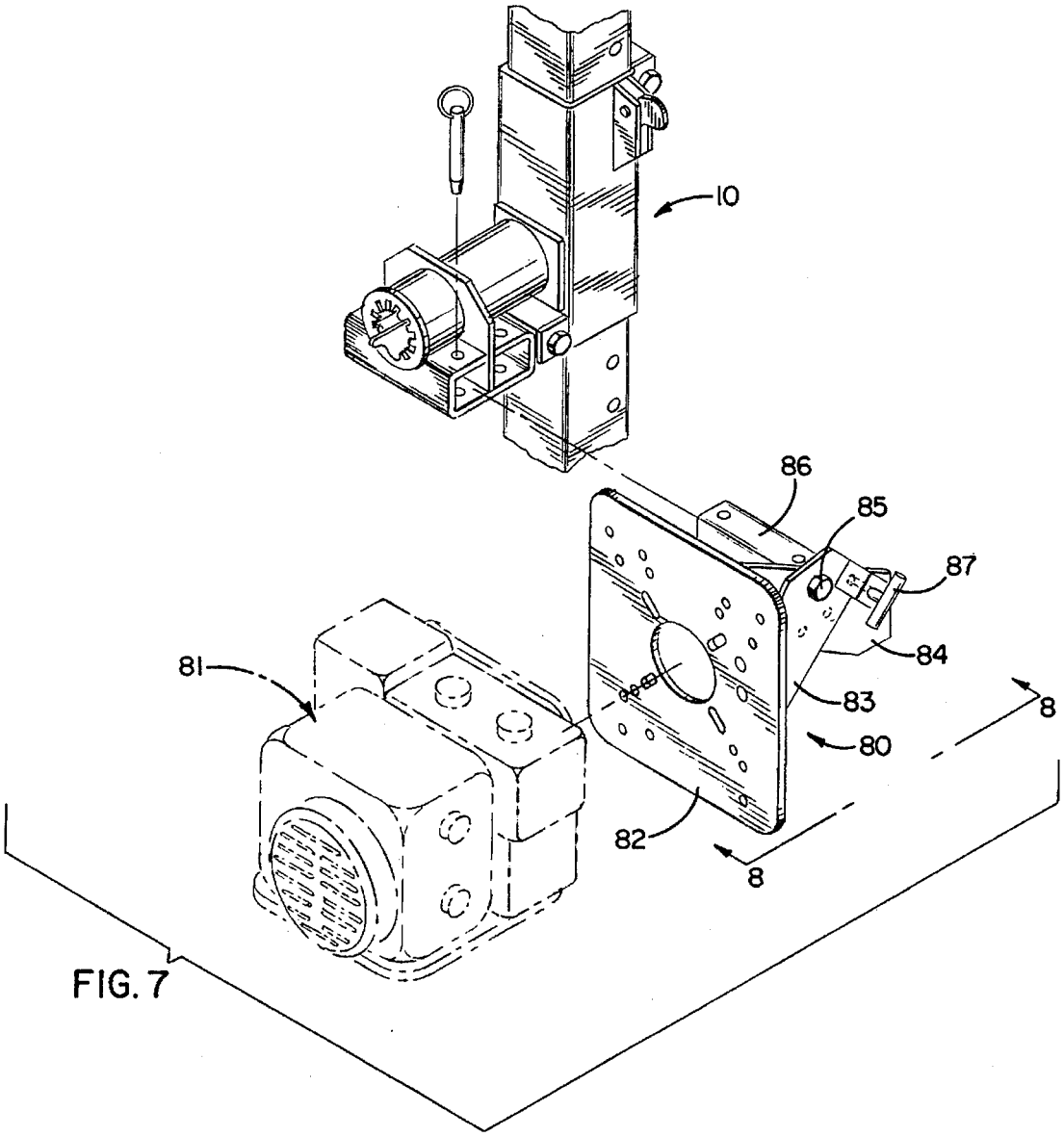
FIG. 7 is an exploded perspective view showing the apparatus set up for servicing of an engine.

FIG. 6 shows the apparatus 10 set up for servicing a device 71 having an elongated bar 72, the device being, for example, a string trimmer. To support the device, provision is made of a service bracket 75 having an apertured bar 76 for telescoping into one of the tubes 50 having a clamp 77 with flexible portions 70 for receiving the bar 72 of the trimmer 71. After the bar 72 has been inserted into the flexible portions, the latter are squeezed together by turning screws 79 and thus securely clamp the bar.

Figure 8:
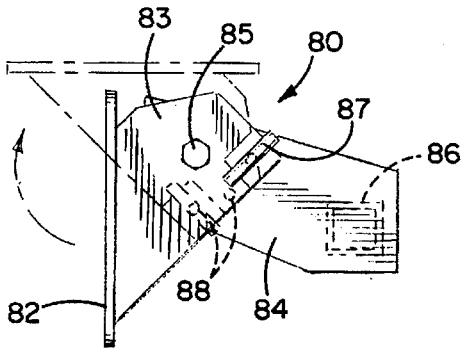
FIG. 8 is a side elevational view as seen in the direction of the arrows of the line 8—8 of FIG. 7.

In FIG. 8, a service bracket 80 for an engine 81 is illustrated. The bracket includes an apertured plate 82 to which the engine may be bolted. An arm 83 is carried by the plate 82 and is pivotally connected to a second arm 84 by a bolt 85. The arm 84 is carried on the free end of a bar 86 adapted to be telescoped into one of the tubes 50. The plate 82 may be pivoted about the bolt 85 to various positions relative to the bar 86 and may be latched in a selected position by a pin 87 adapted to be inserted through one of a plurality of angularly spaced holes 88 in the arm 83 and a hole in the arm 84.

Figure 9:
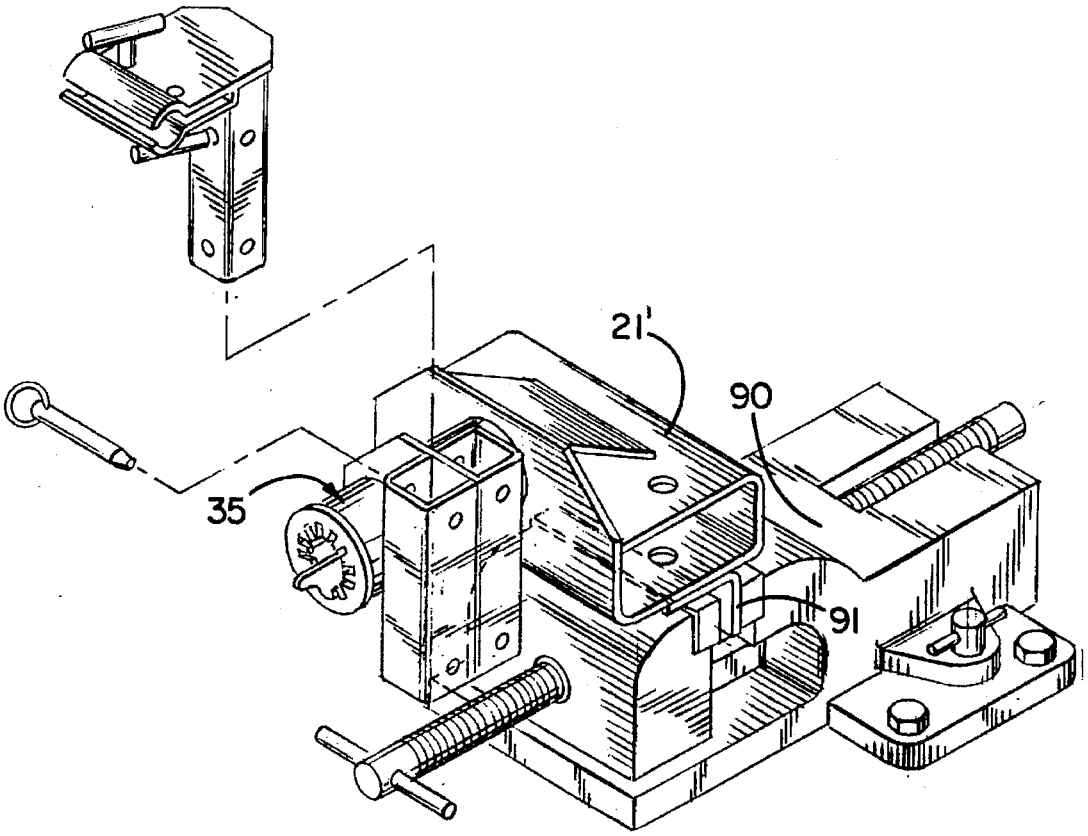
FIG. 9 is an exploded perspective view showing the apparatus mounted by a bench vice.

The apparatus 10 formed by the support 18 and the subsupport 35 may be easily constructed for use in a bench-mounted vise 90 (FIG. 9). To this end, an angle iron 91 is bolted to the underside of a main support formed by a length of tube 21' and carrying the sub-support 35. The angle iron 91 may be clamped between the jaws of the vice 90 to enable the latter to securely hold the tube 21' and the subsupport 35 during servicing of a device such as a string trimmer or a chain saw. The tube 21' also may be bolted directly to a work bench using the same holes used to bolt the angle iron to the tube.

I claim:

1. Work holding apparatus comprising a main support, a subsupport mounted on said main support to rotate about a predetermined axis, means for releasably holding said subsupport in selected angular positions about said axis, said subsupport comprising first and second side-by-side tubes extending transversely of said axis, each of said tubes being sized to telescopically receive a work holder, at least one work holder having a bar telescoped slidably in one of the tubes, and means for releasably pinning the work holder to each of said tubes so as to prevent the work holder from sliding in the tube as the subsupport is pivoted about the main support.

2. Work holding apparatus as defined in claim 1 wherein said pinning means comprises a first hole in said one tube, a plurality of second holes spaced along said bar, and a pin adapted to be inserted through said first hold and into any selected one of said second holes whereby said bar may be adjusted endwise of said tube by inserting said pin into different ones of said second holes and locked to prevent sliding as the subsupport is rotated about the main support.

3. Work holding apparatus as defined in claim 1 in combination with a first set of work holders comprising a pair of L-shaped members having first sections comprising oppositely directed rods telescoped into respective ones of the tubes, and parallel troughs extending from the respective bars, the bars having a plurality of apertures coordinated with the pinning means.

4. Work holding apparatus as defined in claim 3 in which said first set of work holders comprise first and second elongated bars, respectively, said pinning means comprising holes formed in and spaced along each of said bars, comprising holes formed in said tubes, and comprising first and second pins, said first and second pins being inserted through the holes in said first and second tubes, respectively and being inserted into a selected one of the holes in said first and second bars, respectively, whereby each bar may be adjusted endwise of its respective tube by inserting the respective pin into different ones of the holes in the bar.

5. Work holding apparatus as defined in claim 3 in which said main support and said subsupport comprise first and second sleeves, respectively, said second sleeve being telescoped with said first sleeve and being rotatable relative to said first sleeve about said axis, said holding means comprising a latch supported by one of said sleeves to move between latched and unlatched positions, a plurality of angularly spaced detents carried by the other sleeve, said latch normally being disposed in said latched position and coacting with a selected one of said detents to hold said second sleeve in a selected angular position relative to said first sleeve, said latch being manually movable to said unlatched position and being free of said detents when in said unlatched position so as to enable rotation of said second sleeve relative to said first sleeve.

6. Work holding apparatus comprising a main support, a subsupport mounted on said main support to rotate about a predetermined axis, means for releasably holding said subsupport in selected angular positions about said axis, said subsupport comprising first and second side-by-side tubes extending transversely of said axis, each of said tubes being sized to telescopically receive a work holder, and means for releasably attaching a work holder to each of said tubes; wherein:

said main support and said subsupport comprise first and second sleeves, respectively, said second sleeve being telescoped with said first sleeve and being rotatable relative to said first sleeve about said axis, said holding means comprising a latch supported by one of said sleeves to move between latched and unlatched positions, a plurality of angularly spaced detents carried by the other sleeve, said latch normally being disposed in said latched position and coacting with a selected one of said detents to hold said second sleeve in a selected angular position relative to said first sleeve, said latch being manually movable to said unlatched position and being free of said detents when in said unlatched position so as to enable rotation of said second sleeve relative to said first sleeve; and said second sleeve is telescoped over said first sleeve, said latch comprising a latching member having a free end portion and pivotally supported in said first sleeve to swing between said latched and unlatched positions, a plate attached to said second sleeve and having an axially extending opening for receiving the free end portion of said latching member when said latching member is in said unlatched position, said detents comprising a plurality of notches formed in and spaced angularly around the edge portion of said opening, said latching member being received in one of said notches when said latching member is in said latched position.

7. Work holding apparatus as defined in claim 6 further including means on the free end portion of said latching member and engageable with said plate to retain said second sleeve axially on said first sleeve when said latching member is in said latched position.

8. Work holding apparatus comprising first and second sleeves, said second sleeve being telescoped onto and rotatable relative to said first sleeve, means on said second sleeve for supporting a work holder, and means for holding said second sleeve releasably in a preselected angular position relative to said first sleeve, said holding means comprising a latching member having a free end portion and pivotally supported in said first sleeve to swing between latched and unlatched positions, a plate attached to said second sleeve and having an axially extending opening for receiving the free end portion of said latching member when said latching member is in said unlatched position, and a plurality of notches formed in said plate and spaced angularly around the edge portion of said opening, said latching member being received in one of said notches when said latching member is in said latched position.

9. Work holding apparatus as defined in claim 8 further including means on the free end portion of said latching member and engageable with said plate to retain said second sleeve axially on said first sleeve when said latching member is in said latched position.

10. Work holding apparatus as defined in claim 8 in which said supporting means comprise a tube attached to and extending transversely of said second sleeve for telescopically receiving the work holder, and a second tube attached to and extending transversely of said second sleeve and disposed in side-by-side relation with said first tube for telescopically receiving a second work holder.

11. Work holding apparatus as defined in claim 3 further including a second work holder comprising a rod telescoped within one of said tubes and a bracket for supporting a chain saw.

12. Work holding apparatus as defined in claim 3 further including a second work holder comprising a rod telescoped within one of said tubes and a bracket for supporting a string trimmer.

13. Work holding apparatus as defined in claim 3 further including a second work holder comprising a rod telescoped within one of said tubes and a bracket for supporting an engine.

* * * * *